US006139282A

United States Patent [19]

Ota et al.

[11] Patent Number: 6,139,282

[45] Date of Patent: Oct. 31, 2000

[54] VARIABLE CAPACITY REFRIGERANT COMPRESSOR WITH AN ALUMINUM CAM PLATE MEANS

[75] Inventors: Masaki Ota; Hisakazu Kobayashi; Masaru Hamasaki; Masayoshi Hori, all of Kariya, Japan

[73] Assignee: Kabushiki Kaisha Toyoda Jidoshokki Seisakusho, Kariya, Japan

[21] Appl. No.: 09/032,635

[22] Filed: Feb. 27, 1998

[30] Foreign Application Priority Data

Feb. 28, 1997 [JP] Japan ..... 9-046649

[51] Int. Cl.[7] ..... F04B 1/26

[52] U.S. Cl. ..... 417/222.2; 417/269; 92/71

[58] Field of Search ..... 417/222.2, 269; 92/71; 91/499

[56] References Cited

U.S. PATENT DOCUMENTS

| | | | |
|---|---|---|---|
| 4,073,603 | 2/1978 | Abendschein et al. . | |
| 4,801,248 | 1/1989 | Tojo et al. . | |
| 5,105,728 | 4/1992 | Hayase et al. . | |
| 5,336,056 | 8/1994 | Kimura et al. . | |
| 5,567,124 | 10/1996 | Takenaka et al. | 417/222.2 |
| 5,762,476 | 6/1998 | Ota et al. | 417/222.2 |

FOREIGN PATENT DOCUMENTS

| | | |
|---|---|---|
| 3904240 | 2/1989 | Germany . |
| 4290950 | 3/1992 | Germany . |
| 19527675 | 7/1995 | Germany . |
| 3258975 | 11/1991 | Japan . |

*Primary Examiner*—Charles G. Freay
*Attorney, Agent, or Firm*—Burgess, Ryan & Wayne

[57] ABSTRACT

A variable capacity single-headed piston type refrigerant compressor provided with an aluminum-made cam plate rotating with an axial drive shaft to cause reciprocation of a plurality of single-headed pistons within respective cylinder bores, the cam plate further axially moving in parallel with the drive shaft to adjustably change its angle of inclination with respect to a reference plane perpendicular to the axis of rotation of the drive shaft to thereby adjustably vary the capacity of the compressor, the cam plate being further provided with a weight made of iron system material and generating a centrifugal force on the cam plate during the rotation of the cam plate to thereby produce a moment M2 counteracting an unfavorable moment M1 acting on the cam plate due to the high-speed reciprocation of the pistons.

19 Claims, 9 Drawing Sheets

VARIABLE CAPACITY REFRIGERANT COMPRESSOR WITH AN ALUMINUM CAM PLATE MEANS

BACKGROUND OF THE INVENTION

1. Field of the Invention The present invention relates to a variable capacity refrigerant compressor adapted for being incorporated in an automobile climate control system to compress a refrigerant gas and, more particularly, relates to a construction of a cam plate of a variable capacity single-headed piston type refrigerant compressor in which the angle of inclination of the cam plate is adjustably changed with respect to a reference plane, i.e., a plane perpendicular to an axis of rotation of the drive shaft of the compressor, to vary the delivery capacity of the compressed refrigerant gas in compliance with a compression requirement of the climate control system.

2. Description of the Related Art

A typical conventional variable capacity refrigerant compressor is provided with a cylinder block for defining therein a plurality of cylinder bores, a front housing connected to the front end of the cylinder block to define therein a crank chamber for receiving a piston drive mechanism including a cam plate, and a rear housing connected to the rear end of the cylinder block to define therein a suction chamber and a discharge chamber. A drive shaft is rotatably supported by the front housing and the cylinder block to extend through the crank chamber. The drive shaft is arranged to be connectable to an external drive source such as an automobile engine. The cylinder bores of the cylinder block are provided for receiving a plurality of pistons to be reciprocated by the piston drive mechanism. The cam plate of the piston drive mechanism is mounted around the drive shaft within the crank chamber to be rotatable with the drive shaft, and can change its angle of inclination with respect to a plane perpendicular to the axis of rotation of the drive shaft. The cam plate is operatively connected to the pistons to reciprocate the pistons within the respective cylinder bores in response to the rotation of the drive shaft, so that the refrigerant gas is sucked, compressed, and discharged by the pistons.

The crank chamber is fluidly communicated with a suction pressure region and a discharge pressure region of the compressor, and accordingly, a part of the compressed refrigerant gas can be introduced into the crank chamber from the discharge pressure region, and a part of the refrigerant gas is delivered from the crank chamber into the suction pressure region. A capacity control valve is usually provided to regulate either an amount of introduction of the compressed refrigerant gas into the crank chamber or an amount of delivery of the refrigerant gas from the crank chamber into the suction pressure region. Thus, a pressure differential is adjustably produced between the crank chamber and the respective cylinder bores, so that the adjustable pressure differential acts on the back faces of the respective pistons. As a result, the angle of inclination of the cam plate is changed to cause a change in a capacity of the compressed gas discharged from the discharge chamber of the compressor toward the automobile climate control system.

The capacity control valve is arranged to perform the above-mentioned regulating motion in response to a detection of, e.g., a suction pressure of the refrigerant gas. Namely, the detected suction pressure is compared with a predetermined reference pressure, and either the introduction of the discharge pressure refrigerant gas into the crank chamber from the discharge pressure region or the delivery of the refrigerant gas from the crank chamber into the suction pressure region is adjusted to cancel a pressure difference between the detected suction pressure and the predetermined reference pressure.

Nevertheless, the described conventional variable capacity refrigerant compressor must often encounter a problem, to be solved, as set forth below with reference to FIG. 9 schematically illustrating a piston drive mechanism of a variable capacity refrigerant compressor.

As shown in FIG. 9, in the conventional refrigerant compressor, since the drive shaft is usually driven by the automobile engine, the speed of reciprocation of pistons 101 driven by a piston drive mechanism 100 is increased when the engine speed is increased. Thus, the pistons 101 exhibit an excessively increased inertial force F1 which acts on a cam plate 102 of the piston drive mechanism 100 to provide it with a moment M1 which increases an angle of inclination of the cam plate 102. Therefore, even if the capacity control valve of the compressor (not shown in FIG. 9) operates so as to maintain an intermediate capacity condition of the compressor, the cam plate 102 of the piston drive mechanism 100 is moved toward the position of maximum inclination angle thereof, due to the action of the moment M1, to increase the capacity of the compressor. As a result, the suction pressure decreases far below the predetermined reference pressure. Thus, the capacity control valve operates so as to quickly reduce a differential between the suction pressure and the predetermined reference by returning the cam plate 102 toward the position of the minimum inclination angle. However, the quick return of the cam plate 102 to the minimum inclination angle position causes an excessive reduction in the capacity of the compressor, and therefore, the suction pressure increases to a pressure level beyond the predetermined reference pressure. Thus, the capacity control valve operates so as to move the cam plate 102 toward the position of the maximum inclination angle, in order to reduce the suction pressure to a pressure level corresponding to the predetermined reference pressure.

It will be understood from the foregoing description that, when the speed of the automobile engine increases, the cam plate 102 carries out a hunting motion between two approximate positions close to the maximum and minimum inclination angle positions even if the capacity control valve operates so as to maintain an intermediate capacity condition of the compressor. Thus, a stable control of the capacity of the variable capacity refrigerant compressor cannot be achieved, and also, the hunting motion of the cam plate produces vibration of the various elements of the compressor and noise. Further, a large change in the capacity of the compressor causes a change in a torque exerted by the automobile engine, and accordingly, the driving performance of the automobile engine is affected.

At this stage, when the cam plate 102 is rotated by a drive shaft about its axis "L" of rotation, a centrifugal force "F2" acts on the cam plate 102 due to its own weight. The centrifugal force "F2" produces a moment "M2" which causes a reduction in the angle of inclination of the cam plate 102 with regard to a plane perpendicular to the axis "L" of rotation of the cam plate. Since the conventional cam plate 102 is generally made of a material of an iron system, the cam plate 102 is a heavy member. When the cam plate 102 is heavy, the centrifugal force "F2" acting on the cam plate 102 is necessarily large. Thus, the moment "M2" is large, and accordingly, during the high speed rotation of the automobile engine, the afore-mentioned moment "M1" is effectively canceled by the moment "M2". Thus, the aforementioned problem of the hunting motion of the cam plate 102 can be considered as being less than serious.

Nevertheless, all refrigerant compressors mounted on automobiles are required to reduce the weight in response to a requirement for reducing the total weight of automobiles. To this end, a proposal has been made to produce the cam plate 102 of a variable capacity refrigerant compressor by using a light material such as aluminum or an aluminum alloy having a small specific gravity. However, when the cam plate 102 is made of a light material a problem occurs in which, even when the automobile engine operatively connected to the compressor rotates at a high speed, the moment M2 produced by the light cam plate 102 is not large enough to effectively cancel the moment "M1". Thus, only the reduction in the weight of the cam plate 102 causes an effect on the driving performance of the automobile engine.

SUMMARY OF THE INVENTION

Therefore, an object of the present invention is to provide a variable capacity refrigerant compressor in which the weight of a cam plate can be reduced while achieving a stable control of the capacity of the compressor even when an external drive source to drive the compressor is rotated at a high speed.

Another object of the present invention is to provide a variable capacity refrigerant compressor provided with a cam plate made of a light metallic material such as an aluminum system material (aluminum or an aluminum alloy) having a small weight by which the cam plate can exert a centrifugal force indispensable for effectively canceling an unfavorable moment acting on the cam plate when the compressor is rotationally driven by an external drive source rotating at a high speed.

In accordance with the present invention, a variable capacity refrigerant compressor, driven by an external drive source, comprises:

- a compressor body including a cylinder block having a plurality of cylinder bores permitting a plurality of pistons to reciprocate therein,
- a drive shaft mounted in the compressor body to be rotatable about an axis of rotation thereof and having an external end thereof to be connected to an external drive source,
- a cam plate mounted around the drive shaft to be rotated together therewith about the axis of rotation of the drive shaft and to be able to change an angle of inclination thereof with respect to the axis of rotation of the drive shaft,
- an engaging means for engaging the cam plate with the plurality of pistons to thereby cause the reciprocation of the plurality of pistons within the cylinder bores, in response to the rotation of the drive shaft and the cam plate, and
- a capacity control means for controlling the capacity of the compressor by adjustably changing the angle of inclination of the cam plate,
- wherein the cam plate is made of an aluminum system material, and is provided with a separate weight means attached thereto, the separate weight means being arranged for permitting the cam plate itself to exert a centrifugal force counteracting an unfavorable moment acting on the cam plate when the cam plate and the drive shaft are rotated at a high speed by the external drive source.

Preferably, the separate weight means is made of a material having a specific gravity which is larger than that of the aluminum system material of which the cam plate is made.

The cam plate is provided with a weight seat formed integrally therewith to have a seating surface projecting from one of opposite faces of the cam plate, so that the weight means is fixedly attached to the seating surface of the weight seat.

The cam plate has a radially outer periphery with which the plurality of pistons are operatively engaged, and the weight seat is arranged at a portion in a radially inner region of the cam plate. The weight means seated on the weight seat is formed as an element radially extending outward from the seating surface of the weight seat with respect to the center of the cam plate. The weight means may have a portion radially projecting outward from the outer periphery of the cam plate.

The cam plate has opposite surface portions with which the plurality of pistons are engaged via shoes arranged to be slidable on the opposite surface portions which are formed to be parallel with the seating surface of the weight seat.

The drive shaft is provided with a rotary support element fixedly mounted thereon to be engaged with the cam plate via a hinge means, so that the cam plate is rotated together with the drive shaft via the rotary support element and the hinge means. The hinge means permits the cam plate to be angularly moved so as to change its angle of inclination from the minimum angle of inclination to the maximum angle of inclination.

Preferably, the maximum angle of inclination of the cam plate is determined when the weight means attached to the cam plate comes into a mechanical contact with the rotary support plate. When the weight means attached to the weight seat is formed as an element radially extending outward from the seating surface of the weight seat with respect to the center of the cam plate, a portion of the weight means coming into mechanical contact with the rotary support plate should preferably be arranged at a position not projecting radially outward from the seating surface of the weight seat.

The cam plate is provided with a through-bore formed therein to permit the drive shaft to extend therethrough, so that the cam plate is supported by the drive shaft. Then, the rotary support element has a contacting surface with which the weight means comes into a mechanical contact, the contacting surface of the rotary support element being formed as a tilted surface substantially parallel with the cam plate being moved to the maximum inclination angle position thereof with respect to the axis of rotation of the drive shaft.

Preferably, the cam plate is received in a crank chamber defined in the compressor body in such a manner that the angle of inclination of the cam plate is adjustably changed by changing a pressure prevailing in the crank chamber to thereby cause a change in a pressure differential between the pressure in the crank chamber and a total of the pressures prevailing in the respective cylinder bores and acting on the respective pistons. Then, the weight means attached to the weight seat may be arranged to have a portion radially projecting outward from the seating surface of the weight seat. The radially projecting portion of the weight means preferably has a plurality of through-holes formed therein as fluid passages permitting the refrigerant gas to pass therethrough within the crank chamber.

Alternatively, the weight means may have a pair of spaced contacting portions coming into mechanical contact with the rotary support element in response to the movement of the cam plate toward the position of its maximum angle of inclination. The pair of spaced contacting portions of the weight means are arranged to be symmetrical with one another with respect to a top dead center of the cam plate.

Preferably, each of the pair of spaced contacting portions is arranged at an outer peripheral portion of the cam plate.

The weight means preferably comprises a heavy element and a fixing means for fixedly attaching the heavy element to the cam plate. The heavy element and the fixing means may be formed as an integral member as required.

Alternately, the heavy element and the fixing means may be formed as separate elements, and the heavy element may be formed as a flat plate element.

BRIEF DESCRIPTION OF THE DRAWINGS

The above and other objects, features and advantages of the present invention will be made more apparent from the following description of the preferred embodiments thereof with reference to the accompanying drawings wherein.

DESCRIPTION OF THE PREFERRED EMBODIMENTS

Figure 1:
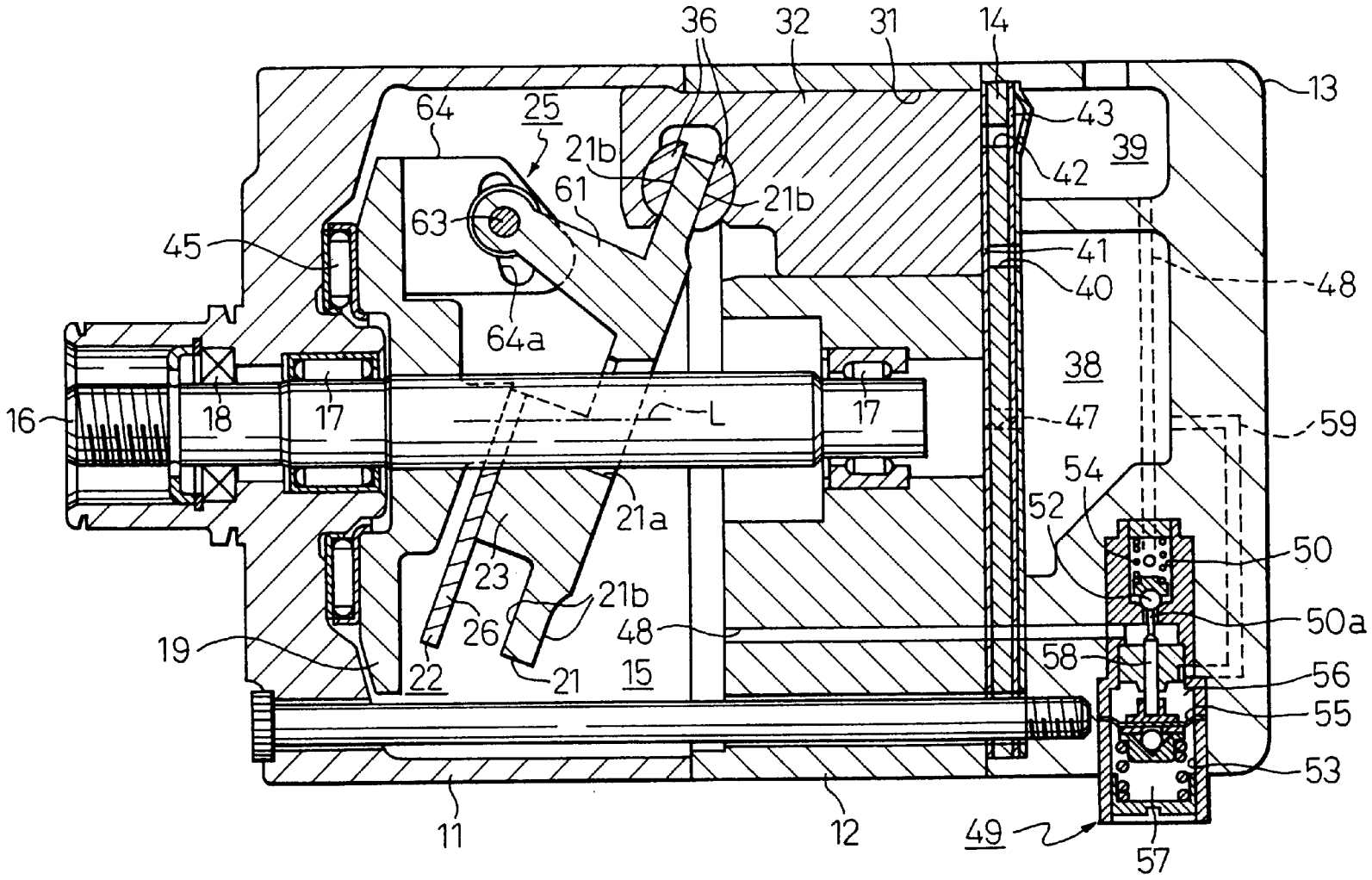
FIG. 1 is a longitudinal cross-sectional view of a variable capacity refrigerant compressor according to a first embodiment of the present invention.

The description of the first through fourth embodiments of the present invention will be provided hereinafter with reference to a variable capacity single headed piston type refrigerant compressor suitable for being incorporated in a vehicle climate control system. However, it should be noted that, throughout the description, the same or like elements and parts are designated by the same reference numerals.

Referring to FIG. 1, a variable capacity single-headed piston type compressor includes a front housing 11, a cylinder block 12 having a front end closed by the front housing 11, and a rear housing 13 provided for closing a rear end of the cylinder block 12 via a valve plate assembly 14. Namely, the front housing 11, the cylinder block 12, and the rear housing 13 are combined together to form a compressor body. The front housing 11 and the cylinder block 12 define a crank chamber 15. A drive shaft 16 is arranged to axially extend through the crank chamber 15, and is rotatably supported by the front housing 11 and the cylinder block 12 via a pair of axially spaced radial bearings 17. The drive shaft 16 has a front end enclosed by a cylindrical sleeve portion formed in a front end of the front housing 11. The front end of the drive shaft 16 is connectable to an external drive source, e.g., a vehicle engine via a suitable clutch device such as a solenoid clutch (not shown). Thus, while the vehicle engine is running, the drive shaft 16 is rotationally driven by the vehicle engine in response to connection of the clutch device. A shaft seal 18 is arranged around the front end of the drive shaft 16 and at an innermost end of the cylindrical sleeve of the front housing 11 so as to seal the interior of the compressor housing against the atmosphere. A rotary support element 19 made of a material of an iron system is fixedly mounted on the drive shaft 16 within the crank chamber 15. The rotary support element 19 is axially and rotatably supported by an inner face of the front housing 11 via a thrust bearing 45.

A swash plate 21 functioning as a cam plate is arranged within the crank chamber 15. The swash plate 21 is made of an aluminum or an aluminum alloy, and typically, is made of an aluminum alloy containing a large amount of silicon. The swash plate 21 is provided with a through-bore 21*a* formed in a central portion thereof, so that the drive shaft 16 extends through the through-bore 21*a*. The swash plate 21 mounted around the drive shaft 16 can slide along the drive shaft 16 in an axial direction coaxial with the axis "L" of rotation of the drive shaft 16, and can be moved to change its angle of inclination with respect to a plane perpendicular to the axis "L" of rotation of the drive shaft 16. A hinge mechanism 25 for pivotally supporting the cam plate 21 is arranged between the rotary support element 19 and the swash plate 21.

Figure 2:
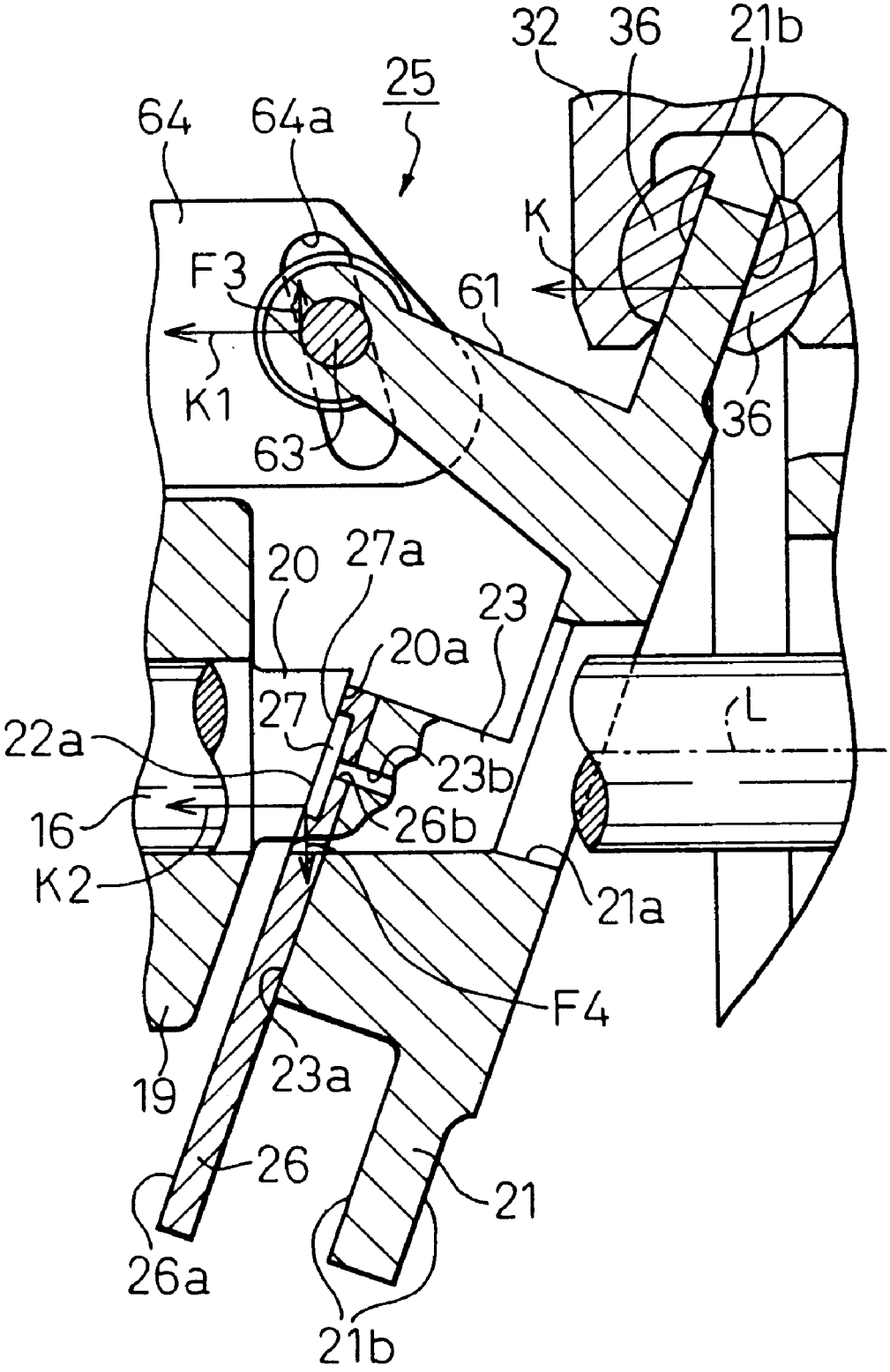
FIG. 2 is an enlarged partial and cross-sectional view of the compressor of FIG. 1, illustrating a cam plate having a weight attached thereto, mounted around a drive shaft and arranged between a hinge mechanism and a plurality of reciprocatory pistons.
Figure 3:
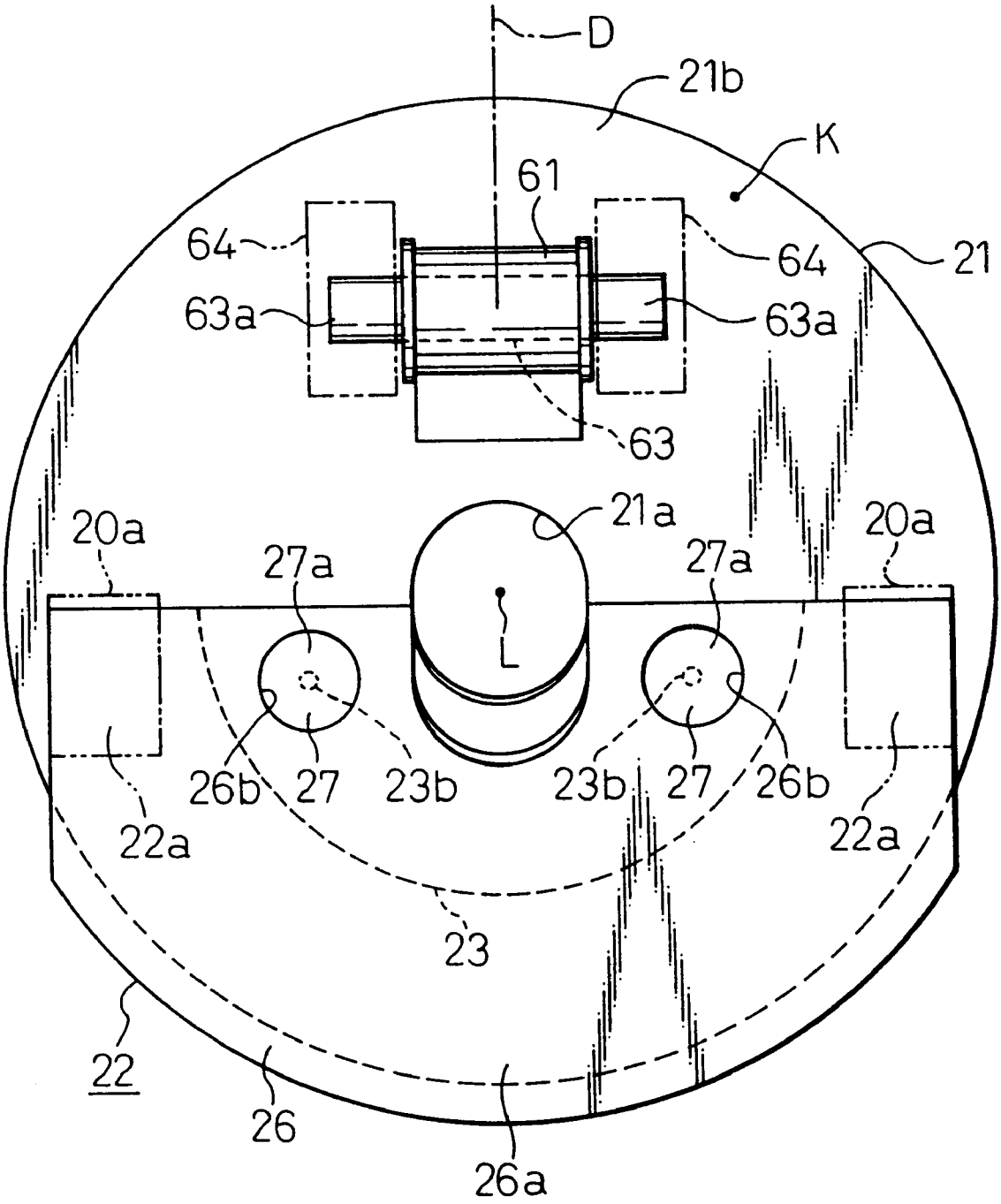
FIG. 3 is an enlarged front view of a swash plate functioning as the cam plate of the compressor of FIG. 1.

As shown in FIGS. 1 through 3, the hinge mechanism 25 is constructed so that a pair of laterally spaced support arms 64, formed as a pair of rearward extensions protruding from a rear end face of the rotary support element 19, pivotally support the swash plate 21 via a swing arm 61 formed integrally with the swash plate 21 and via a guide pin 63. More specifically, the swing arm 61 of the swash plate 21 extends frontward from a front end face of the swash plate 21 to an intermediate position of the pair of laterally spaced support arms 64, and is also disposed at a specific position corresponding to the top dead center "D" of the swash plate 21. The guide pin 63 is inserted in and fixed to a hole formed in an end of the swing arm 61. The laterally spaced pair of support arms 64 are arranged to be symmetrical with one another with respect to the top dead center "D" of the swash plate 21. Each of the support arms 64 is provided with a guide hole 64*a* in the shape of an elongated hole extending substantially radially toward the drive shaft 16 and being slanted rearward with respect to a line perpendicular to the axis "L" of rotation of the swash plate 21. The respective guide holes 64*a*, 64*a* of the support arms 64 are laterally aligned with one another so as to movably receive the guide pin 63 which is fixed to the end of the swing arm 61.

When the drive shaft 16 is rotated by an external drive source, i.e., a vehicle engine, the rotational drive force of the drive shaft 16 is transmitted to the swash plate 21 via the rotary support element 19, the pair of support arms 64, and the swing arm 61. Further, the movement of the swash plate 21 in the axial direction in coincidence with the axis "L" of rotation of the drive shaft 16 as well as the movement of the swash plate 21 to change its angle of inclination with respect to a plane perpendicular to the axis "L" of rotation of the drive shaft 16 are guided by the sliding engagement of the guide pin 63 and the elongated guide holes 64*a* and also by the sliding engagement of the swash plate 21 and the drive shaft 16 which extends through the through-bore 21*a* of the swash plate 21.

A plurality of cylinder bores 31 of the cylinder block 12 are formed as axial bores which are equiangularly arranged around the axis "L" of rotation of the drive shaft 16. The equal number of single-headed pistons 32 are slidably arranged in the cylinder bores 31, respectively. The respective pistons 32 are operatively engaged with the swash plate 21 via shoes 36. More specifically, front and rear faces 21*b* formed in the outer peripheral portion of the swash plate 21 act to linearly reciprocate the respective pistons 32 in the cylinder bores 31 via the respective shoes 36 (each shoe 36 consists of a pair of half-spherical shoes) in response to the rotation of the swash plate 21. The shoes 36 are in sliding contact with the front and rear faces 21*b* of the swash plate 21. During the rotation of the swash plate 21, when the top dead center "D" of the swash plate 21 comes in registration with one of the shoes 36 via the front and rear faces 21*b* of the swash plate 21, the corresponding single-headed piston 32 is moved to the top dead center thereof shown in FIG. 1.

The refrigerant compressor is further provided with a suction chamber 38 for receiving refrigerant gas before compression, and a discharge chamber 39 for refrigerant gas after compression which are formed in the rear housing 13. The suction chamber 38 can be fluidly communicated with the respective cylinder bores 31 via suction ports 40 which are opened and closed by suction valves 41. The discharge chamber 39 can be fluidly communicated with the respective cylinder bores 31 via discharge ports 42 which are opened and closed by discharge valves 43. The suction and discharge valves 41 and 43 are included in the valve plate assembly 14 arranged between the rear end of the cylinder block 12 and the rear housing 13.

The refrigerant gas in the suction chamber 38 is sucked into each of the respective cylinder bores 31 via the open suction port 40 and the suction valve 41 in response to the movement of the corresponding single-headed piston 32 from its top dead center to its bottom dead center. The refrigerant gas in the respective cylinder bores 31 is compressed by the respective pistons 32 in response to the movement of the pistons 32 from the bottom dead center thereof to the top dead center thereof. The compressed refrigerant gas is discharged from the respective cylinder bores 31 into the discharge chamber 39 via the discharge ports 42 and the discharge valves 43.

The thrust bearing 45 arranged between the rotary support element 19 and the inner wall face of the front housing 11 is provided for receiving a thrust force produced by the compression of the refrigerant gas and acting on the rotary support plate 19 via the pistons 32 and the swash plate.

The refrigerant compressor is also provided with a gas extracting passageway 47 bored through the valve plate assembly 14. The gas extracting passageway 47 is arranged for providing a fluid communication between the crank chamber 15 and the suction chamber 38 via small gaps defined among rollers of the rear radial bearing 17.

The refrigerant compressor is further provided with a gas supplying passageway 48 bored through the cylinder block 12, the valve plate assembly 14, and the rear housing 13. The gas supplying passageway 48 is arranged to provide a fluid communication between the discharge chamber 39 and the crank chamber 15 via a capacity control valve 49 operative to adjustably control opening and closing of a portion of the gas supplying passageway 48. The capacity control valve 49 is provided with a valve chamber 50 having a valve port 50*a* formed in the gas supplying passageway 48. A valve element 52 is arranged in the valve chamber 50 to be moved to a first position closing the valve port 50*a* and to a second position opening the valve port 50*a*. A spring element 54 is received in the valve chamber 50 to urge the valve element 52 toward its first position. The capacity control valve 49 is further provided with a large chamber 53 isolated from the valve chamber 50, and defining a pressure sensing chamber 56 and an atmospheric pressure chamber 57 separated by a diaphragm 55. The atmospheric pressure chamber 57 is open to the atmosphere. A valve rod 58 is provided for connecting the valve element 52 to the diaphragm 55 provided between the pressure sensing chamber 56 and the atmospheric pressure chamber 57. A pressure sensing passageway 59 is formed in the rear housing 13, and is arranged to provide a fluid communication between the suction chamber 38 and the pressure sensing chamber 56. Thus, the refrigerant gas in the suction chamber 38 is introduced into the pressure sensing chamber 56 via the pressure sensing passageway 59. Thus, a displacement of the diaphragm 55 occurs in response to an increase or a decrease in the suction pressure of the refrigerant gas introduced from the suction chamber 38, and accordingly, the valve element 52 is moved to adjustably open the valve port 50*a* so that the fluid communication between the discharge chamber 39 and the crank chamber 15 via the gas supplying passageway 48 is adjustably changed. Therefore, the pressure prevailing in the crank chamber 15 is changed so as to cause an adjustable change in a pressure differential between the pressure within the crank chamber 15 and the total pressure in the plurality of cylinder bores 31 acting on the single-headed pistons 32. Accordingly, the angle of inclination of the swash plate 21 is changed in response to the change in the pressure differential, and therefore, the reciprocating stroke of the respective pistons 32 is adjustably changed to vary the discharge capacity of the refrigerant compressor.

For example, when the refrigerating load in the climate control system is large, the suction pressure of the refrigerant gas is increased from a given set value, and therefore, the capacity control valve 49 operates so as to reduce the fluid communication between the discharge chamber 39 and the crank chamber 15. Simultaneously, the pressure of the refrigerant gas prevailing in the crank chamber 15 is reduced by the extraction of the gas from the crank chamber 15 into the suction chamber 38 via the gas extracting passageway 47, and therefore, the angle of inclination of the swash plate 21 is increased toward the maximum angle of inclination. Therefore, the discharge capacity of the refrigerant compressor is increased while causing a reduction in the suction pressure of the refrigerant gas sucked into the suction chamber 38 from the climate control system.

When the refrigerating load in the climate control system is small, the suction pressure of the refrigerant gas is reduced from the given set value, and therefore, the capacity control valve 49 operates so as to increase the fluid communication between the discharge chamber 39 and the crank chamber 15. Accordingly, the refrigerant gas at a high pressure is supplied from the discharge chamber 39 into the crank chamber 15 to increase the pressure prevailing in the crank chamber 15. Thus, the swash plate 21 is moved so as to reduce its angle of inclination toward the minimum angle of inclination, and the reciprocating stroke of the respective pistons 32 is reduced. Therefore, the discharge capacity of the refrigerant compressor is reduced while causing an increase in the suction pressure of the refrigerant gas sucked into the suction chamber 38 from the climate control system.

From the foregoing description of the first embodiment, it will be understood that the capacity control valve 49 of the variable capacity refrigerant compressor controls the discharge capacity of the compressor by changing the angle of inclination of the swash plate 21 (i.e., the cam plate) through implementing a valve action which adjusts the suction pressure of the refrigerant gas with respect to the given set value.

Referring now to FIGS. 2 and 3, the swash plate 21 is provided with a weight seat 23 formed integrally therewith. The weight seat 23 is formed as a projecting portion arranged in a radially inner portion of a front face of the swash plate 21, and is disposed at a position opposite to the hinge mechanism 25 with respect to the axis "L" of the drive shaft 16. As will be understood from the illustration of FIG. 3, the weight seat 23 integral with the front face of the swash plate 21 extends to form a generally U-shape portion enclosing a half of the entire periphery of the centrally arranged through-bore 21*a* on the front side of the swash plate 21. The weight seat 23 is provided with a front seating surface 23*a* which is parallel with the front and rear faces 21*b* of the swash plate 21 making sliding contact with the shoes 36 of the respective pistons 32. The weight seat 23 has a pair of fixing holes 23*b* bored therein at two positions symmetrical with one another with respect to the top dead center "D" of the swash plate 21.

A weight 22 is attached to the weight seat 23. The weight 22 consists of a heavy member 26 made of a material of an iron system, and pin members 27 functioning as fixing members to fix the heavy member 26 to the weight seat 23. The pin members 27 are also made of a material of iron system and are press-fitted in the fixing holes 23*b* of the weight seat 23. The heavy member 26 having a generally U-shape, viewed from the front side, is produced by punching a steel plate by using a press machine. A pair of fixing holes 26*b*, 26*b* are arranged in a radially inner region of the heavy member 26 and at two positions adjacent to an upper edge of the heavy member 26. The two positions of the fixing holes 26*b* are arranged to be symmetrical with one another with respect to the top dead center "D" of the swash plate 21. The heavy member 26 is attached to the weight seat 23 in such a manner that the rear face of the heavy member 26 is in direct contact with the seating surface 23*a* of the weight seat 23, and that the two fixing holes 26*b*, 26*b* are in registration with the fixing holes 23*b*, 23*b* of the weight seat 23. The pin members 27 are press-fitted into the fixing holes 23*b*, 23*b* from a front face 26*a* of the heavy member 26 through the fixing holes 26*b*, 26*b*, and therefore, the heavy member 26 is rigidly fixed to the weight seat 23.

The heads of the two pin members 27 are seated so that end faces 27*a* of the heads are made even with the front face 26*a* of the heavy member 26.

As clearly shown in FIG. 3, an outer peripheral portion of the heavy member 26 fixed to the weight seat 23 projects radially outward from the seating surface 23*a* beyond the circumference of the weight seat 23. Further, the outermost portion of the heavy member 26, which is disposed to be opposite to the swing arm 61 with respect to the axis "L" of the drive shaft 16, projects outward beyond the outer circumference of the swash plate 21. The heavy member 26 is formed as a flat plate having an equal thickness, and accordingly, the front face 26*a* of the heavy member 26 is parallel with the front face 21*b* of the swash plate 21.

The maximum angle of inclination of the swash plate 21 is defined when the swash plate 21 is moved to be in contact with, and stopped by, a pair of projections 20 having contacting faces 20*a*, respectively. The projections 20 are arranged in a rear face of the rotary support element 19 at two spaced positions symmetrical with one another with respect to the axis "L" of the drive shaft 16. As is shown in FIGS. 2 and 3, the swash plate 21 is in contact with the contacting faces 20*a* of the projections 20 via a pair of laterally spaced contacting portions 22*a*, 22*a* (portions enclosed by a two-dot line in FIG. 3) defined in the front face 26*a* of the heavy member 26 of the weight 22 at two laterally spaced positions symmetrical with one another with respect to the top dead center "D" of the swash plate 21. Thus, when the swash plate 21 is moved to the position to have the maximum angle of inclination thereof, the contacting portions 22*a*, 22*a* of the weight 22 are in face-to-face contact with the contacting faces 20*a* of the projections 20, 20 of the rotary support element 19. It should be noted that the contacting faces 20*a*, 20*a* of the projections 20, 20 are formed as inclined faces which are parallel with the front faces 26*a* of the heavy member 26 and the front face 21*b* of the swash plate 21 when the swash plate 21 along with the weight 22 are moved to the position of the maximum angle of inclination of the swash plate 21.

Although not shown in FIGS. 2 and 3, the minimum angle of inclination of the swash plate 21 is defined by a contacting engagement of opposite ends 63*a* of the guide pin 63 attached to the end of the swing arm 61 with radially inner ends of the guide holes 64*a* formed in the pair of support arms 64 of the rotary support element 19.

Figure 9:
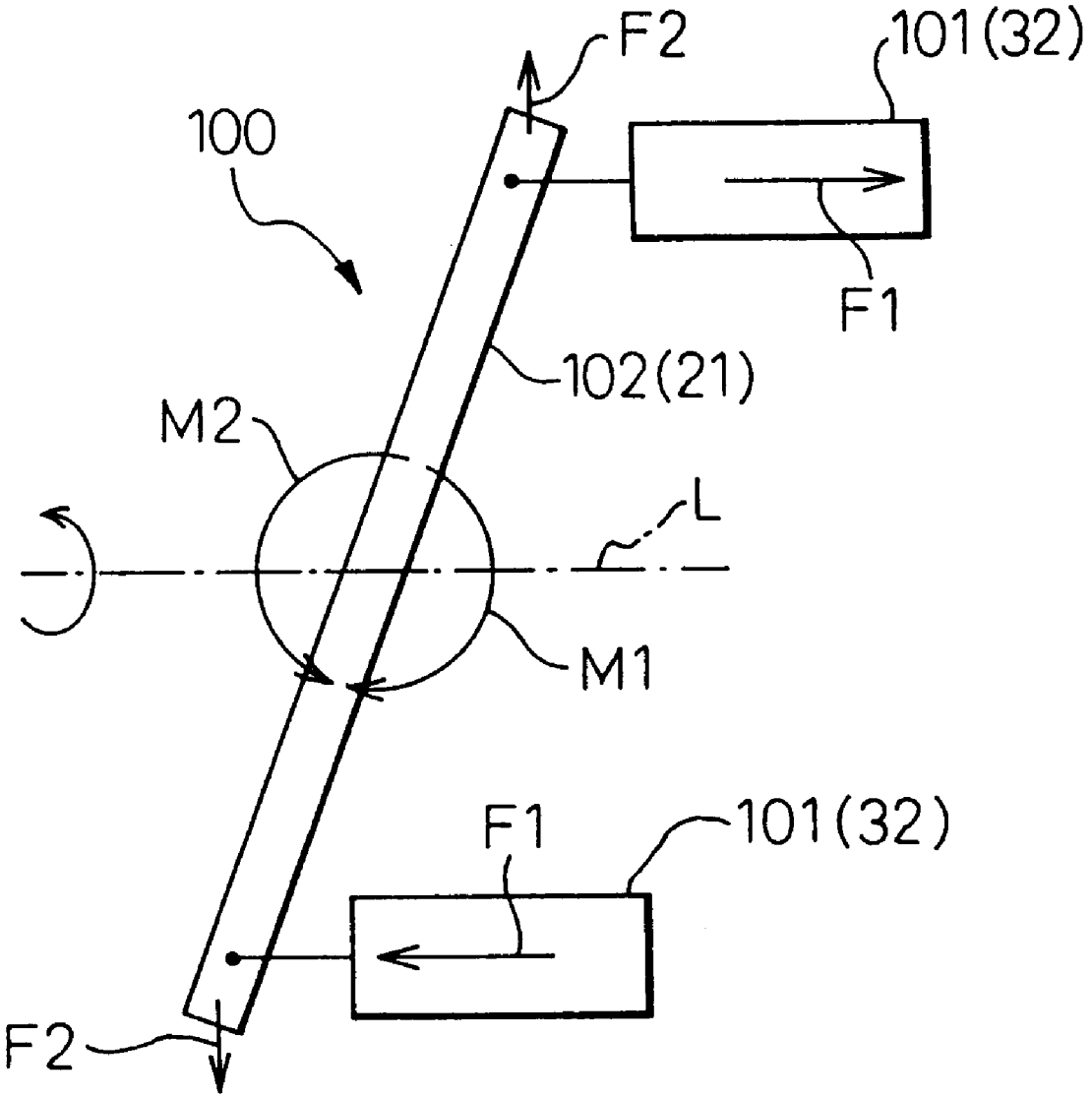
FIG. 9 is a schematic view of a basic piston drive mechanism incorporated in a variable capacity refrigerant compressor.

As shown in FIG. 9, when the rotating speed of the vehicle engine to which the drive shaft 16 of the compressor is connected is increased, the rotating speed of the swash plate 21 about the axis "L" is in turn increased to increase the reciprocating speed of the respective single-headed pistons 32. Thus, an inertial force F1 of each of the pistons 32 is increased to increase a moment M1 which acts on the swash plate 21 with the weight 22 so as to increase an angle of inclination of the swash plate 21. Nevertheless, during the rotation of the swash plate 21 and the weight 22, a large amount of centrifugal force F2 acts on the swash plate 21 while generating a large moment M2 which acts on the swash plate 21 so as to reduce the angle of inclination of the swash plate 21. Accordingly, the above-mentioned moment M1, acting on the swash plate 21 can be effectively canceled by the latter moment M2 also acting on the swash, plate 21. Namely, even when the vehicle engine is rotated at a high speed, the moment M1 generated by the inertial force F1 of the single-headed pistons 32 does not adversely affect on the movement of the swash plate 21 to adjustably change its angle of inclination by the control of the capacity control valve 49.

The variable capacity single-headed piston type refrigerant compressor provided with the swash plate (the cam plate) having the weight attached thereto can exhibit a number of advantages as set forth below.

Since the swash plate 21 is made of aluminum or aluminum alloy, a reduction in the weight of the swash plate 21 can be achieved. At this stage, a weight necessary for generating a given centrifugal force F2 acting on the swash plate 21 during the rotation of the swash plate 21 is provided by the weight 22 which is produced separately from the swash plate 21. According to the separate construction of the swash plate 21 and the weight 22, the material of which the weight 22 is made, the shape of the weight 22, the position where the weight 22 is attached to the swash plate 21 can be freely determined to satisfy the necessity for obtaining the above-mentioned centrifugal force F2 acting on the swash plate 21. Namely, compared with the integral construction of the swash plate and the weight, the above-mentioned separate construction of the swash plate 21 and the weight 22 permits it to obtain a weight made of a most preferred material and having a most preferred shape suitable for being attached to a most preferred position of the swash plate 21. Thus, the swash plate 21 having the weight 22 attached thereto can produce a most appropriate centrifugal force F2 required for producing the moment M2 to cancel the undesirable moment M1. Thus, both a reduction in the weight of the swash plate 21 and a stable control of the capacity of the refrigerant compressor can be achieved even when the external drive source is rotated at a high speed.

The swing arm 61 and the guide pin 63 which are indispensable elements of the hinge mechanism 25 are arranged at a position spaced from the axis "L" of rotation of the drive shaft 16 and the swash plate 21. Therefore, the weight 22 which is arranged on the opposite side to the hinge mechanism 25 with respect to the axis "L" can function as a counter weight to balance the hinge mechanism 25. Namely, the centrifugal force F2 is always dynamically balanced by the opposite arrangement of the hinge mechanism 25 and the weight 22. Thus, the dynamically balanced swash plate 21 can smoothly rotate about the axis "L" of rotation of the drive shaft 16 without producing a vibratory motion of the drive shaft 16.

Since the weight 22 having the heavy member 26 and the fixing pins 27 is made of a material of an iron system, the specific gravity of the iron system is appreciably larger than that of the material (an aluminum or an aluminum alloy) of which the swash plate 21 is made. Thus, even if the size of the weight 22 is small, the weight 22 can produce a desired amount of centrifugal force F2 effective for producing the moment M2 acting on the swash plate 21 to cancel the undesired moment M1. Therefore, a reduction in the size of the swash plate 21 and in turn a reduction in the entire size of the refrigerant compressor can be achieved.

The weight 22 is fixedly attached to the weight seat 23 integral with the swash plate 21 and projects vertically from the front face 21*b* of the swash plate 21. Therefore, when an operation to attach the weight 22 to the swash plate 21 is carried out by using the fixing pins 27 press-fitted into the fixing holes 23*b* of the weight seat 23 of the swash plate 21 and the fixing holes 26*b* of the weight 22, a stress acting as a reactive force due to the press-fitting operation of the fixing pins 27 can be directly assumed by the weight seat 23, and does not directly act on portions of the swash plate 21 other than the weight seat 23. Accordingly, it is possible to prevent specific portions of the swash plate 21 such as the front and rear faces 21*b*, 21*b* of the swash plate 21, which must be formed as accurate portions, from being strained. Thus, an accuracy of the swash plate 21 can be maintained during the assembling operation to attach the weight 22 to the swash plate 21.

If the weight 22 were made of a material having a relatively small specific gravity, the weight 22 would have to be attached to an appropriate outermost portion of the swash plate 21 to obtain a desired amount of centrifugal force F2. Nevertheless, since the outer portion of the swash plate 21 is operatively engaged with the respective pistons 32, the outer portion of the swash plate 21 cannot be used for attaching the weight 22 thereto. Thus, the weight seat 23 for attaching the weight 22 thereto is intentionally arranged at a radially inner portion of the swash plate 21. The weight seat 23 formed as a vertical projection with respect to the front face 21*b* of the swash plate 21 can be a spacing member to arrange the weight 22 at a position spaced from the front face 21*b* of the swash plate 21. As a result, the weight 22 can be attached to the swash plate 21 at a position suitable for permitting an outer circumference of the weight 22 to be extended along the outer circumference of the swash plate 21 without causing a mechanical interference with the rear ends of the respective single-headed pistons 32 during the rotation of the swash plate 21.

The swash plate 21 is provided with the front and rear slide-contact faces 21*b* and the seating surface 23*a* of the weight seat 23 which are designed to be parallel with one another. Therefore, when the swash plate 21 is manufactured by machining, if the slide-contact faces 21*b* are first machined and used as reference faces, the seating surface 23*a* of the weight seat 23 can be subsequently and easily machined with reference to the first-machined slide-contact faces 21*b*. On the other hand, if the seating surface 23*a* of the weight seat 23 is first machined and used as a reference surface, the slide-contact faces 21*b* are subsequently and easily machined with reference to the machined seating surface 23*a*. As a result, the manufacturing of the swash plate 21 can be simplified at a rather low manufacturing cost. For example, when each swash late 21 is initially formed by die casting method, and is subsequently machined to obtain a final product of the swash plate 21, a production of the dies per se can be simplified because inner surfaces of the dies corresponding to the seating surface 23*a* and the slide-contact faces 21 of the swash plate 21 can be easily machined. Thus, a reduction in the production cost of the dies can be expected.

Since the weight 22 is formed to be attached to the swash plate 21 in such a manner that a part of the outer portion of the weight 22 is protruded radially outwardly beyond the outermost circumference of the swash plate 21, the weight 22 can act a desired amount of centrifugal force F2 on the swash plate 21, so that the controlling of the inclination angle of the swash plate 21 can be easily achieved.

Since the maximum angle of inclination of the swash plate 21 is determined by a mechanical contacting of the weight 22 attached to the swash plate 21 and the rotary support element 19, the swash plate 21 made of an aluminum or aluminum alloy material can be prevented from directly contacting the rotary support element 19 made of an iron system material. Thus, the swash plate 21 can be prevented from abrading. Further, the maximum angle of inclination of the swash plate 21 can be adjustably and easily changed by changing the thickness of the weight 22, particularly, the thickness and shape of the contacting portions 22*a*, 22*a* formed in the heavy member 26 of the weight 22. Therefore, the maximum capacity of the refrigerant compressor can be adjustably changed as required.

When the swash plate 21 is moved to its position of the maximum angle of inclination, a large force "K" (see FIG. 2) due to the compression of the refrigerant gas acts on the swash plate 21 via the respective pistons 32. Thus, a part of the force "K", i.e., a partial force K1 acts on front inner faces of the elongated guide holes 64*a* of the support arms 64 via the swing arm 61 of the swash plate 21 and the guide pin 63 attached to the end of the swing arm 61. Since the above-mentioned front inner faces of the elongated guide holes 64*a* are formed to radially extend toward the drive shaft 16 while being slanted rearwardly, a reactive force of the above-mentioned force K1 produces a force component F3 which urges the swash plate 21 to be substantially radially pushed up via the guide pin 63 with respect to the drive shaft 16. Nevertheless, the contacting faces 20*a* of the rotary support element 19 are slanted to be in parallel and contact with the weight 22 attached to the swash plate 21 when the swash plate 21 is moved to its maximum angle of inclination. Thus, a reactive force of a different partial force K2 (see FIG. 2) of the force "K" produces a force F4 (see FIG. 2) acting on the swash plate 21 so as to cancel the above-mentioned force component F3. Thus, the swash plate 21 can be prevented from being pushed up by the force component F3. As a result, the through-bore 21*a* of the swash plate 21 can be prevented from being strongly pressed against the drive shaft 16. Therefore, it is possible to prevent the inner face of the through-bore 21*a* of the swash plate 21 from abrading.

The pair of contacting portions 22*a*, 22*a* of the heavy member 26 of the weight 22 are arranged to be spaced from one another in the front face 26*a* of the heavy member 26. Accordingly, when the swash plate 21 is moved to its maximum angle of inclination, the swash plate 21 comes in engagement with the rotary support plate 19 through the contacting of the two spaced contacting portions 22*a* of the weight 22 with the two spaced contacting faces 20*a* of the projections 20 formed in the rotary support element 19. Thus, the swash plate 21 can be stably supported and held by the rotary support element when the swash plate 21 is moved to the maximum angle of inclination in order to conduct the maximum capacity operation of the compressor.

Further, the pair of contacting portions 22*a*, 22*a* of the heavy member 26 of the weight 22 are arranged to be symmetrical with one another in the front face 26*a* of the heavy member 26 of the weight 22 with regard to the top dead center "D" of the swash plate 21. In addition, each of the pair of contacting portions 22*a*, 22*a* of the heavy member 26 is arranged at a position in an outer peripheral portion of the heavy member 26 of the weight 22. Namely, the space between the two contacting portions 22*a* of the heavy member 26 is very large. Thus, when the swash plate 21 is subjected to the above-mentioned large force K due to the compression of the refrigerant gas at the maximum angle of inclination thereof, the force K can be stably received by the two spaced contacting portions 22*a* of the heavy member 26 of the weight 22 contacting with the contacting faces 20*a* of the rotary support element 19. Thus, it is possible to prevent the swash plate 21 from being subjected to a large bending moment which might be caused by the force K if the force K acting on the swash plate 21 were received by a single contacting portion or point of the swash plate 21. Therefore, while the swash plate 21 is rotating at its position maintaining the maximum angle of inclination thereof, the swash plate 21 neither vibrates nor generates noise, and permits the refrigerant compressor to perform the maximum capacity operation thereof.

Since the heavy member 26 of the weight 22 consists of a plate member made of an iron system material, it is possible to form the heavy member 26 by punching it from a steel plate by using a press machine. The steel plate can be easily obtained and, thus, the weight 22 consisting of the heavy member 26 and the fixing pins 27 can be formed at a very low manufacturing cost.

In the afore-described first embodiment of the refrigerant compressor, the contacting portions 22*a* of the weight 22 which come into contact with the projections 20 of the rotary support element 19 are arranged at two spaced positions in the outermost peripheral portion of the front face 26*a* of the heavy member 26 attached to the seating surface 23*a* of the weight seat 23. Thus, as clearly shown in FIG. 3, the contacting portions 22*a* of the weight 22 are formed at positions which cannot be directly supported by the weight seat 23. Thus, when the swash plate 21 is moved to its maximum angle of inclination as shown in FIG. 1, a reactive force to the force K, produced by the compression of the refrigerant gas, directly acts on the outer peripheral portion of the heavy member 26 of the weight 22. As a result, the heavy member 26 of the weight 22 might cause a deformation during the continuous operation of the compressor.

Therefore, the refrigerant compressor of a second embodiment adopts a different construction to stop an assembly of a swash plate 21 and a weight 22 when the assembly is moved to a position where the swash plate 21 takes the maximum angle of inclination.

Figure 4:
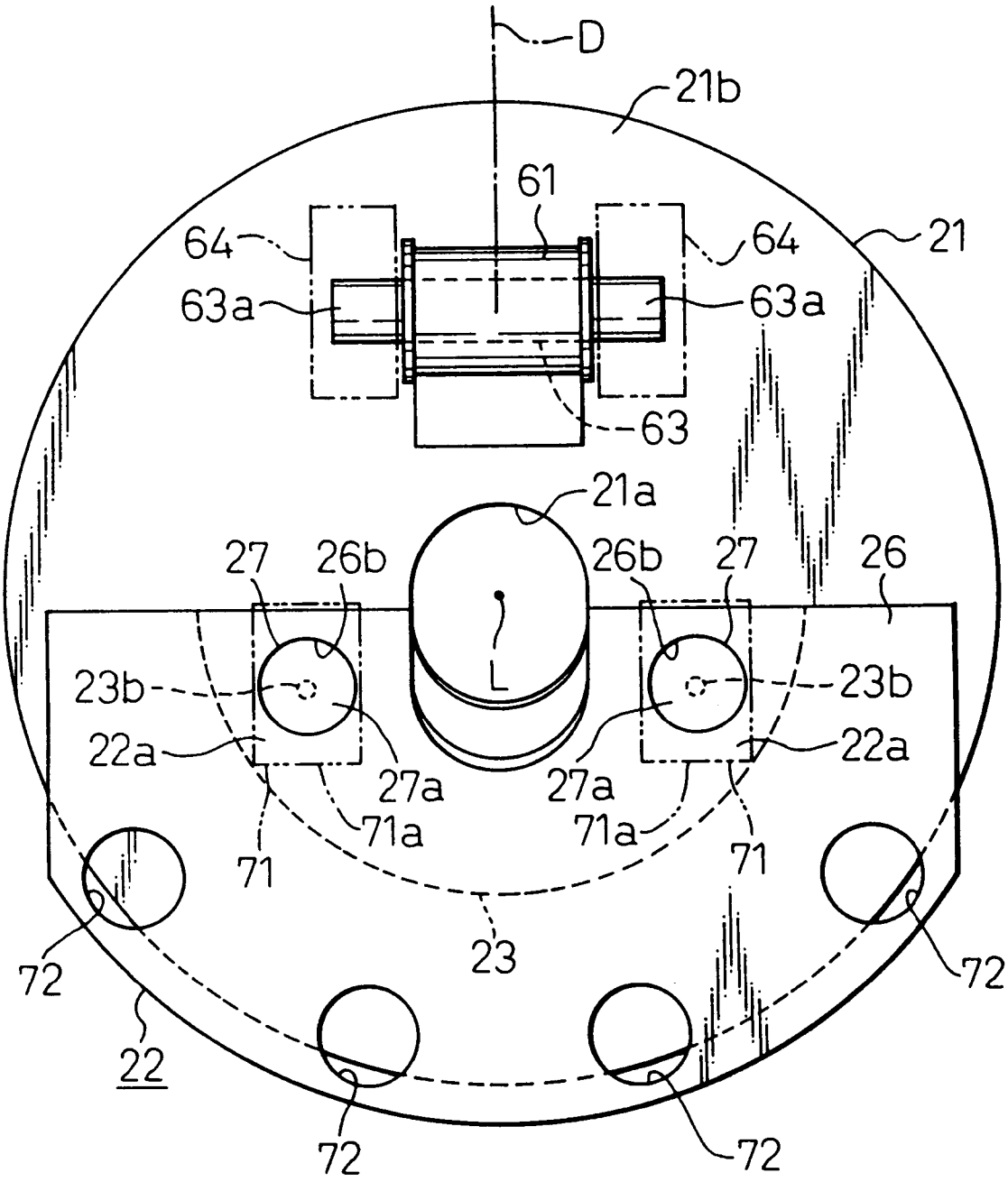
FIG. 4 is a similar enlarged front view of a swash plate, i.e., a cam plate and a weight attached thereto, according to a second embodiment of the present invention.

FIG. 4 illustrates the second embodiment of the present invention, i.e., an assembly of a swash plate and a weight to be incorporated in a variable capacity single-headed type refrigerant compressor according to the second embodiment.

In the compressor of the second embodiment, the pair of laterally spaced projections 20, 20 of the first embodiment are omitted, and alternatively, a pair of projections 71 are provided for stopping the assembly of swash plate 21 and weight 22 when the swash plate 21 is moved to its maximum angle of inclination.

Although the projections 71 have a construction similar to that of the projections 20, the projections 71 are provided in a portion of the rotary support element 19 on the rear side thereof to have such an arrangement in which the projections 71 are disposed at positions within a radially inner region of the rotary support element 19 so as to be symmetrical with one another as shown in FIG. 4. The pair of projections 71 are provided with contacting faces 71*a* which come in contact with the end faces 27*a* of the fixing pins 27 to secure the heavy member 26 to the swash plate 21 and a portion of the front face 26*a* of the heavy member 26 which extends around the fixing pin 27 when the swash plate 21 is moved to its maximum angle of inclination. Therefore, the contacting portions 22*a* of the weight 22 can be directly supported by the weight seat 23 when a reactive force of the force K2 produced by the compression of the refrigerant acts on the heavy member 26 of the weight 22. Therefore, the heavy member 26 of the second embodiment can be prevented from being subjected to the afore-mentioned unfavorable bending moment.

Further, the heavy member 26 of the weight 22 of the second embodiment is provided with a plurality of through-holes 72 formed in the radially outer peripheral portion of the weight 22. In the illustrated embodiment, four through-holes 72 are arranged equidistantly on a circle. The through-holes 72 in the weight 22 are provided for establishing a fluid communication between two regions of the crank chamber 15 extending on front and rear sides of the assembly of the swash plate 21 and the weight 22. Namely, the through-holes 72 are provided to allow the refrigerant gas within the crank chamber 15 to flow therethrough from one of the two regions to the other and vice versa during the continuous operation of the compressor. Therefore, an increase and reduction in a pressure prevailing in the crank chamber 15 quickly occurs to obtain a quick response in the controlling of the capacity of the compressor.

Figure 5:
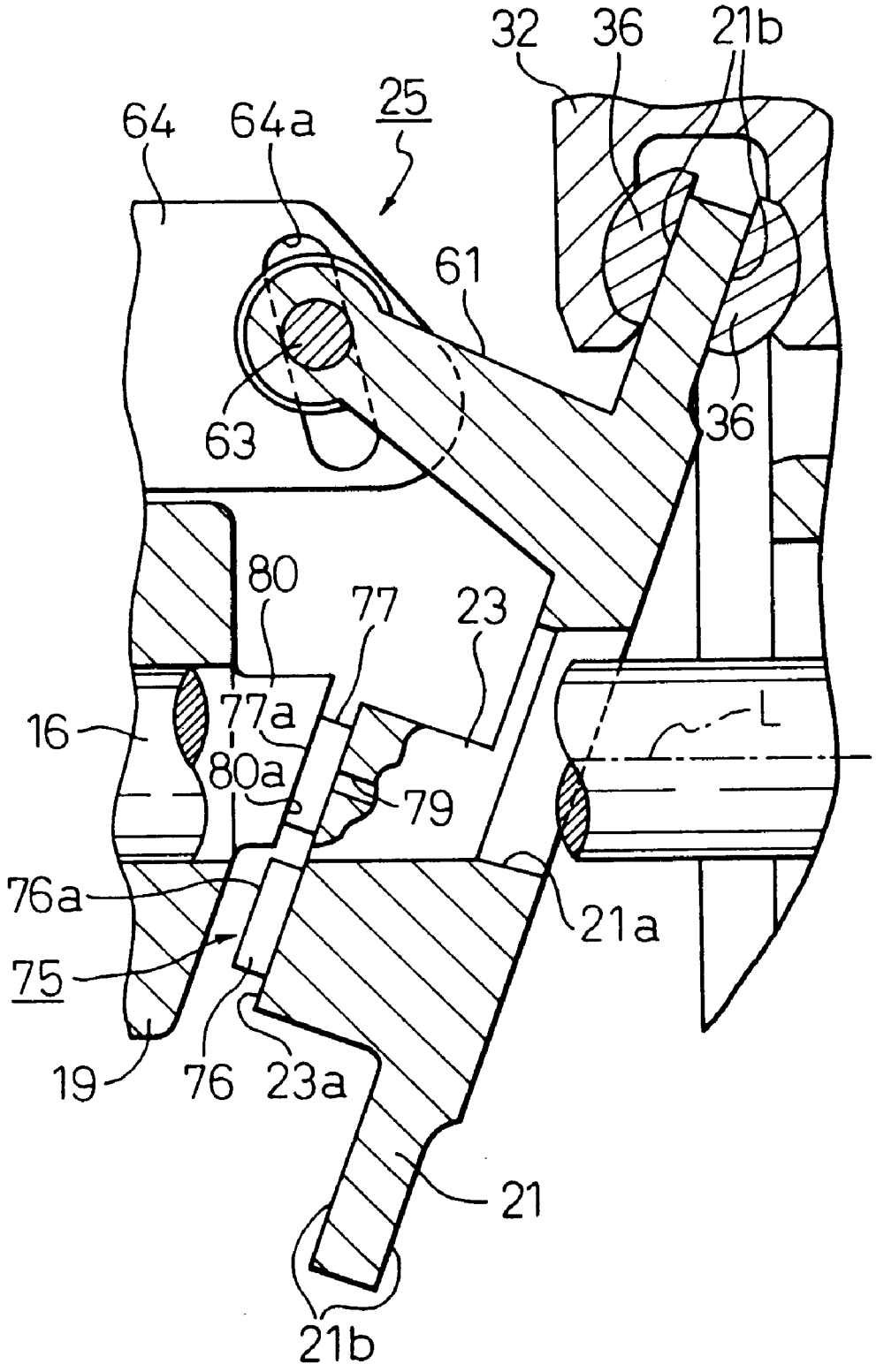
FIG. 5 is an enlarged partial and cross-sectional view of a variable capacity refrigerant compressor according to a third embodiment of the present invention, illustrating a swash plate functioning as a cam plate and a weight attached to the plate, which are mounted around a drive shaft between a hinge mechanism and a plurality of pistons.
Figure 6:
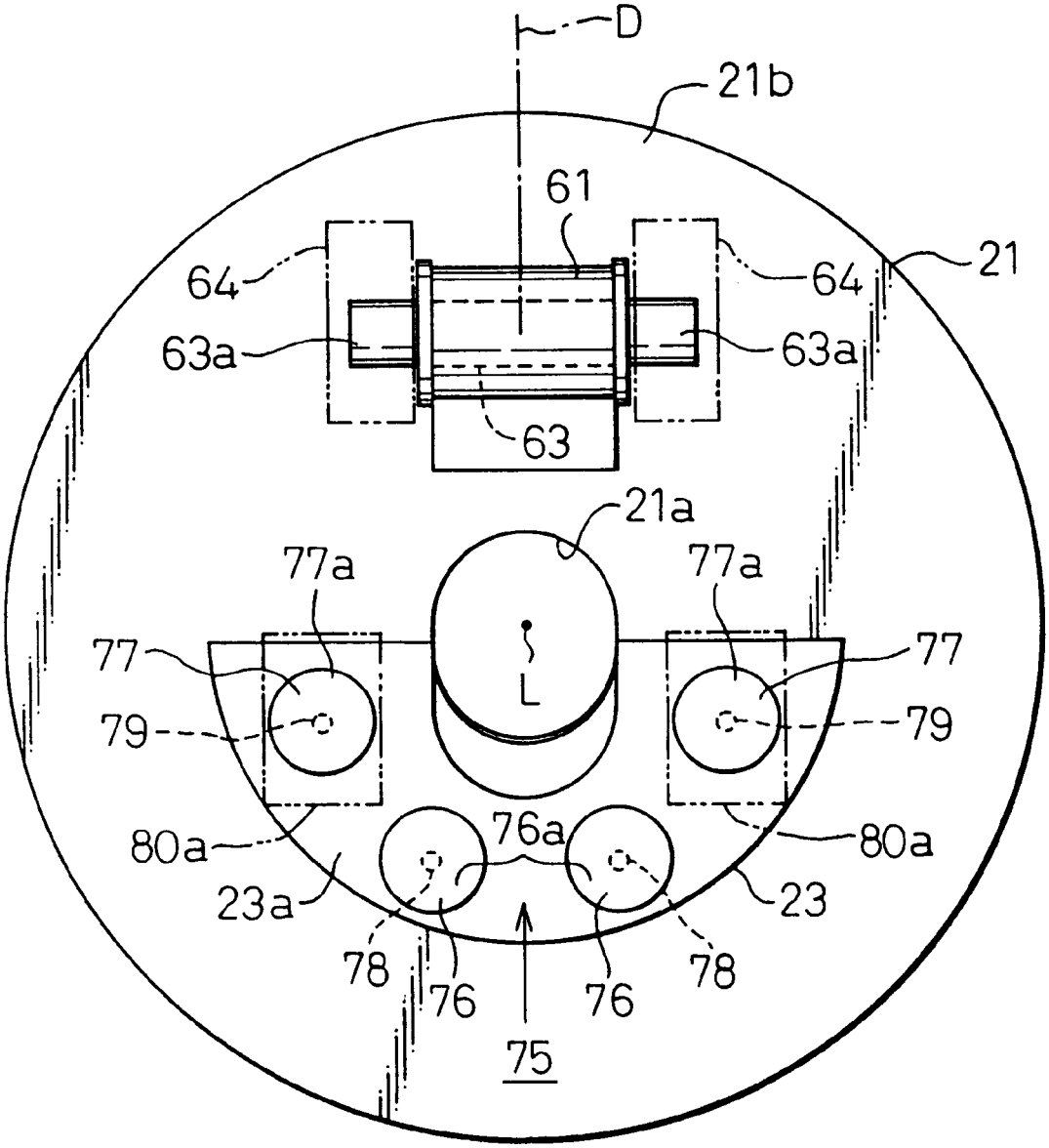
FIG. 6 is a front view of the swash plate of FIG. 5.

FIGS. 5 and 6 illustrate a third embodiment of the present invention. In the variable capacity single-headed piston type refrigerant compressor of the third embodiment, a weight 75 attached to the swash plate 21 includes a plurality of rivets 76 and 77 forcedly fitted in fixing holes of the weight seat 23 of the swash plate 21. The respective rivets 76 and 77 are made of an iron system material having a large specific gravity, and therefore, can act as a unified heavy weight producing a large centrifugal force acting on the swash plate 21. The construction of the respective rivets 76 and 77 can be substantially similar to that of the press-fitted type fixing pins 27 of the first and second embodiments, and accordingly, each of the rivets 76, 77 has a large head portion seated on the swash plate 21 and a pin portion to be fixedly inserted in fixing holes 78 and 79.

The fixing holes 78 for the first set of rivets 76 are arranged in the seating surface 23*a* of the weight seat 23 to be symmetrical with one another with regard to the top dead center "D" of the swash plate 21. The other fixing holes 79 for the second set of rivets 77 are also arranged in the seating surface 23*a* of the weight seat 23 to be symmetrical with one another with regard to the top dead center "D" of the swash plate 21. However, the fixing holes 78 are spaced from the top dead center "D" farther than the fixing holes 79 as will be seen from FIG. 6.

The head portion of each of the first set of rivet 76 has an end face 76*a* which is projected from the seating surface 23*a* of the weight seat 23, and the head portion of each of the second set of rivet 77 has an end face 77*a* which is also projected from the seating surface 23*a* of the weight seat 23.

The refrigerant compressor of the third embodiment is provided with a pair of projections 80 to determine the position of the maximum angle of inclination of the swash plate 21. The projections 80 are formed in a rear side portion of the rotary support element 19 and arranged to be symmetrical with one another with respect to the axis "L" of rotation of the drive shaft 16. Thus, when the swash plate 21 is moved so as to increase its angle of inclination, and when the end faces 77*a* of the head portions of the second set of rivets 77 come in contact with the contacting surfaces 80*a* of the pair of projections 80, the movement of the swash plate 21 is stopped by the projections 80, and the maximum angle of inclination of the swash plate 21 is determined.

In the described third embodiment of the present invention, since the weight 75 consists of the rivets 76, 77 which can be simply press-fitted in fixing holes 78, 79 of the weight seat 23 of the swash plate 21, the weight 75 can be an assembly of simple and low cost mechanical members.

The other construction of the compressor of the third embodiment may be similar to the compressor of the first embodiment of the present invention.

Figure 7:
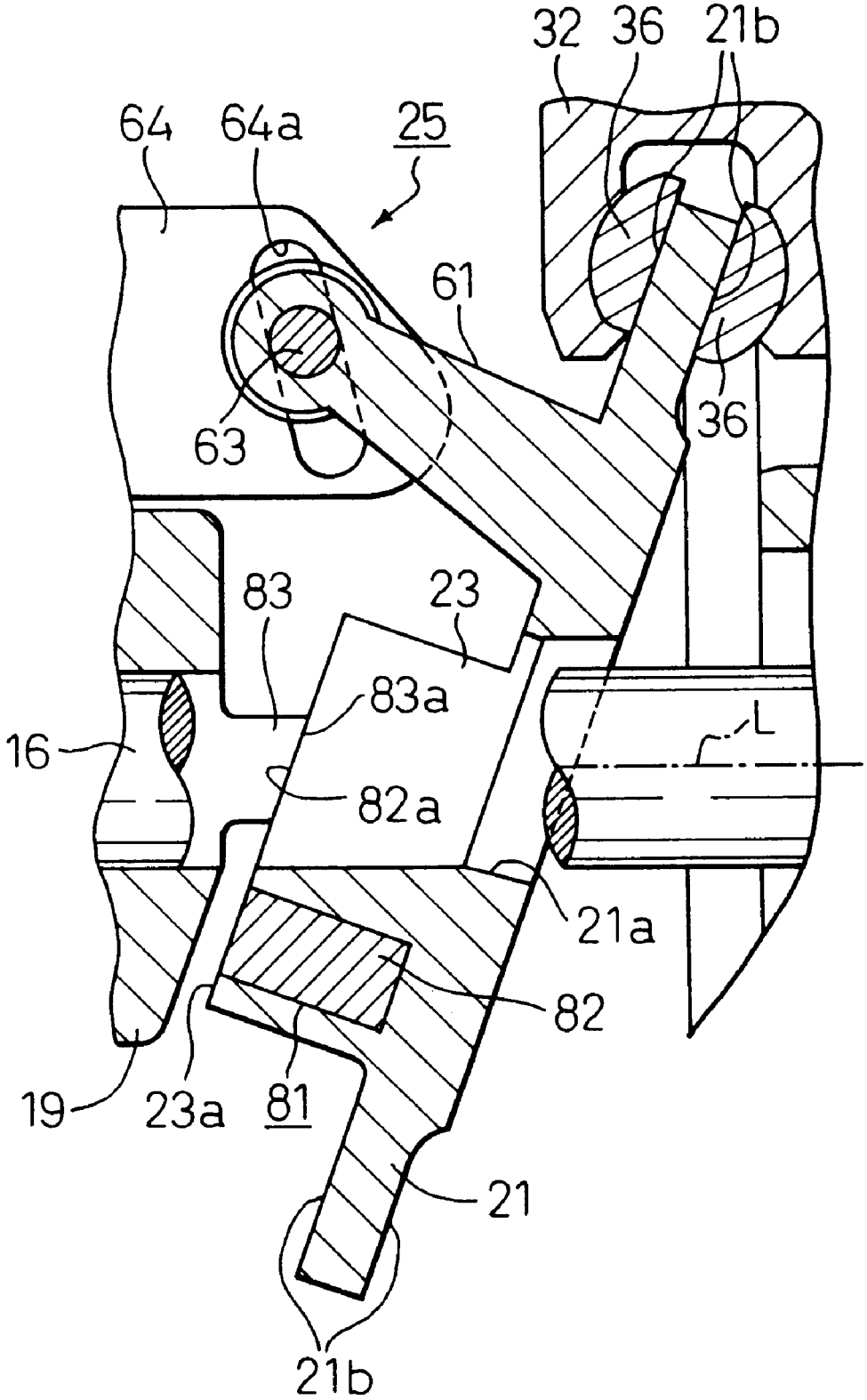
FIG. 7 is an enlarged partial and cross-sectional view of a variable capacity refrigerant compressor according to a fourth embodiment of the present invention, illustrating a swash plate functioning as a cam plate and a weight attached to the plate, which are mounted around a drive shaft between a hinge mechanism and a plurality of pistons.
Figure 8:
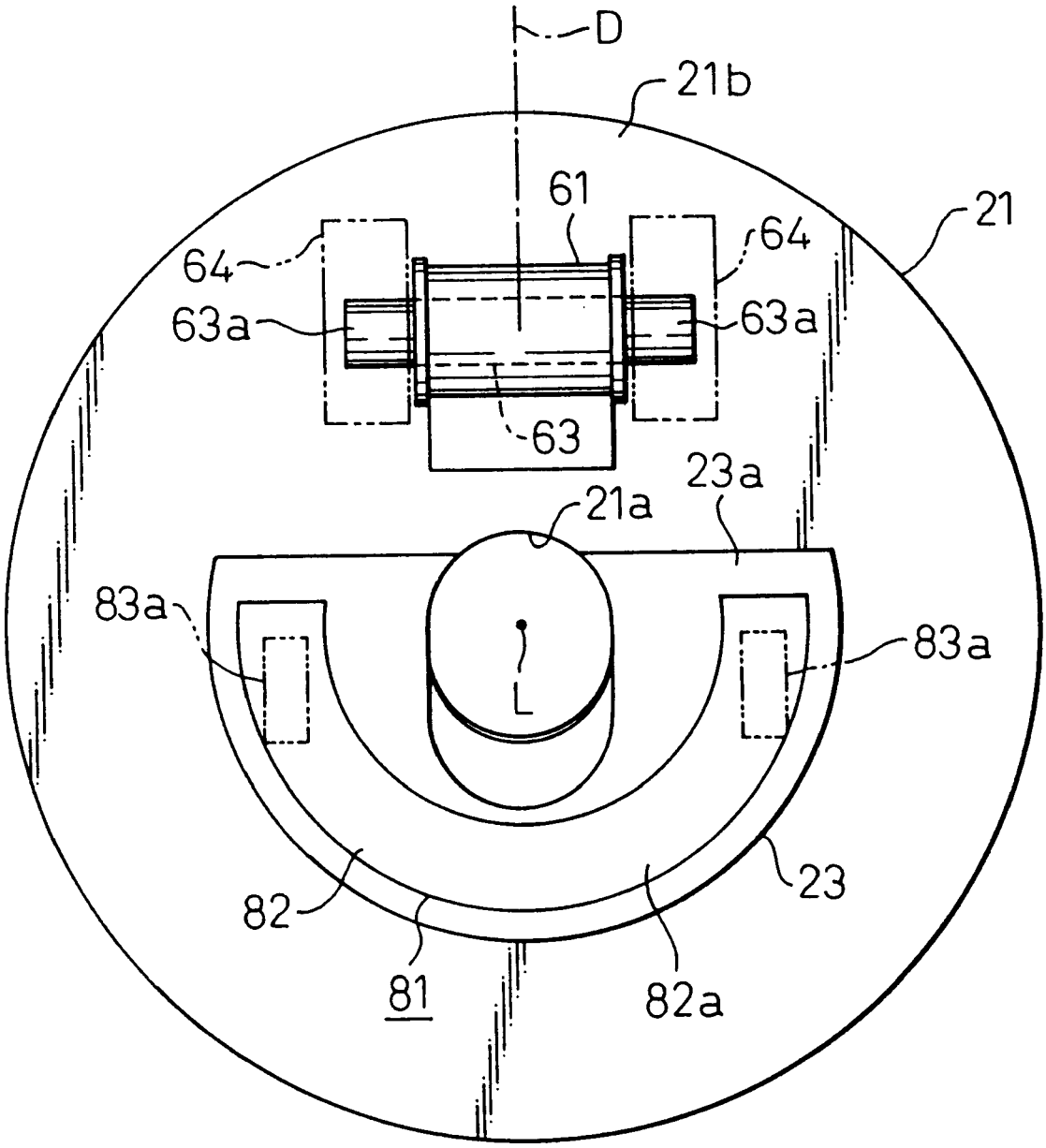
FIG. 8 is a front view of the swash plate of FIG. 7.

FIGS. 7 and 8 illustrate a fourth embodiment of the present invention.

In the variable capacity single-headed piston type compressor of the fourth embodiment, the swash plate 21 is provided with a weight 81 consisting of only a heavy member 82. Namely, since the swash plate 21 made of an aluminum or an aluminum alloy is manufactured by die-casting method, the heavy member 82 made of a material having a specific gravity sufficiently larger than that of the aluminum of which the swash plate 21 is made. For example, the heavy member 82 of the weight 81 can be made of an iron system material, and is embedded in a portion of the weight seat 23 of swash plate 21 during the die-casting process. The heavy member 82 of the weight 81 is formed as a semi-circularly extending member having an exposed upper surface even with the seating surface 23*a* of the weight seat 23.

The compressor of the fourth embodiment is provided with a pair of projections 83 formed in a rear side portion of the rotary support element 19, and arranged to be symmetrical with one another with respect to the axis "L" of rotation of the drive shaft 16. Thus, when the swash plate 21 is moved so as to increase its angle of inclination, and when the upper surfaces 82*a* of the heavy member 82 come in contact with the contacting surfaces 82*a* of the pair of projections 83, the movement of the swash plate 21 is stopped by the projections 83, and the maximum angle of inclination of the swash plate 21 is determined.

In the described refrigerant compressor of the fourth embodiment of the present invention, the heavy member 82 of the weight 81 is fixed to the weight seat 23 of the swash plate 21 during the die-casting process of the swash plate 21 without using any particular fixing means. Namely, the fixing of the weight 81 to the swash plate 21 can be achieved by one manufacturing process to produce the swash plate 21, and accordingly, the manufacturing cost of the assembly of the swash plate 21 and the weight 81 can be much reduced.

The other construction of the refrigerant compressor of the fourth embodiment may be similar to the compressor of the first embodiment.

Although the description of the most preferred first through fourth embodiments of the present invention is provided hereinbefore with reference to FIGS. 1 through 9, it should be understood that many modifications to the described embodiments will occur to a person skilled in the art within the scope and spirit of the present invention.

For example, the heavy member 26 and the fixing pins 27 of the weight 22 according to the first and second embodiments may be formed as an integral element as required. Namely, the fixing pins 27 may be formed as projections provided in the rear face of the heavy member 26 and press-fitted in the fixing holes 23*b* of the weight seat 23 of the swash plate 21. Then, the weight 22 can consist of a single mechanical member.

At least one of the heavy member 26 and the fixing pins 27 of the weight 22 according to the first and second embodiments may be made of a material other than the iron system such as an aluminum material having a specific gravity larger than that of the aluminum material of which the swash plate 21.

The fixing pins 27 of the first and second embodiments may be changed from press-fitted type pins to either rivets or screw bolts as required.

The heavy member 26 of the weight 22 of the first and second embodiments of the present invention may be fixed to the weight seat 23 by an appropriate strong adhesive as required.

The rivets 76 and 77 of the weight 75 of the third embodiment of the present invention may be formed to have various different weights so that the centrifugal force F2 acting on the swash plate 21 may be delicately adjusted by a combination of rivets 76 and 77 having different weights.

In the described first through fourth embodiments, the hinge mechanism 25 arranged between the rotary support element 19 and the swash plate 21 may be modified so that the guide pin 63 may come into contact with the radially uppermost end of the elongated guide holes 64*a* of the support arms 64 when the swash plate 21 is moved to its maximum angle of inclination. Thus, the weights 22, 75 and 81 may be arranged to be prevented from coming into contact with the rotary support element 19 when the swash plate 21 is at its maximum angle of inclination. Therefore, the weights 22, 75 and 81 are not required to be made of abrasion resistant material. Thus, the weight 22, 75 or 81 may be various materials other than the iron system material if the materials have a large specific gravity capable of providing a desired amount of centrifugal force F2. Further, fixing of the weight 22, 75 or 81 to the swash plate 21 may be less accurate.

From the foregoing description of the preferred embodiments of the present invention, it will be understood that in accordance with the present invention, the cam plate (the swash plate) of the variable capacity single-headed piston type compressor can be made of an aluminum material having a relatively small specific gravity. Thus, reduction in the weight of the swash plate and in turn in the weight of the compressor per se can be achieved. Simultaneously, a stable control of the capacity of the compressor, when the external drive source to drive the compressor is rotated at a high speed, can be achieved by the adoption of a separate weight which is attached to the weight seat of the cam plate.

Further, since the weight attached to the swash plate is made of a material having a large specific gravity compared with that of the aluminum material of which the cam plate is made, it is possible to form the weight as an element having a small size. Accordingly, the whole size of the compressor can be reduced so that the compressor may be easily mounted in a small mounting space available in a vehicle engine compartment.

Further, due to the separate construction of the cam plate and the weight attached to the cam plate, a desired and adjustable amount of centrifugal force acting on the cam plate can be obtained to cancel an unfavorable moment acting on the cam plate during the compression of the refrigerant gas.

It should be understood that many variations and modifications will occur to a person skilled in the art without departing from the spirit and scope of the present invention as claimed in the accompanying claims.

What we claim:

1. A variable capacity refrigerant compressor, driven by an external drive source, comprising:

a compressor body including a cylinder block having a plurality of cylinder bores permitting a plurality of pistons to reciprocate therein;

a drive shaft mounted in said compressor body to be rotatable about an axis of rotation thereof and having an external end thereof for connection with an external drive source;

a cam plate mounted around said drive shaft to be rotated together therewith about the axis of rotation of said drive shaft and to be able to change an angle of inclination thereof with respect to the axis of rotation of said drive shaft;

a rotary support element fixedly mounted on the drive shaft engaged with the cam plate by a hinge means;

an engaging means for engaging said cam plate with said plurality of pistons to thereby cause reciprocation of said plurality of pistons within said cylinder bores, in response to the rotation of said drive shaft and said cam plate; and a capacity control means for controlling the capacity of said compressor by adjustably changing the angle of inclination of said cam plate;

wherein said cam plate is made of an aluminum system material, and is provided with a separate weight means attached thereto, said separate weight means being arranged for permitting said cam plate to produce a centrifugal force counteracting an unfavorable moment acting on said cam plate when said cam plate and said drive shaft are rotated at a high speed by said external drive source and wherein the maximum angle of inclination of the cam plate is determined when the weight means come into contact with the rotary support plates.

2. The variable capacity refrigerant compressor according to claim 1, wherein said separate weight means is made of a material having a specific gravity which is larger than that of the aluminum system material of which said cam plate is made.

3. The variable capacity refrigerant compressor of claim 2 wherein the separate weight means and rotary support element are made of an iron system material.

4. The variable capacity refrigerant compressor according to claim 1, wherein said cam plate is provided with a weight seat formed integrally therewith to have a seating surface projecting from one of opposite faces of said cam plate, so that said weight means is fixedly attached to said seating surface of said weight seat.

5. The variable capacity refrigerant compressor according to claim 4, wherein said cam plate has a radially outer periphery with which said plurality of pistons are operatively engaged, and wherein said weight seat is arranged at a portion in a radially inner region of said cam plate, said weight means seated on said weight seat being formed as an element radially extending outward from said seating surface of said weight seat with respect to a center of said cam plate.

6. The variable capacity refrigerant compressor according to claim 5, wherein said weight means has a portion radially projecting outward from said radially outer periphery of said cam plate.

7. The variable capacity refrigerant compressor according to claim 4, wherein said cam plate has opposite surface portions with which said plurality of pistons are engaged via shoes arranged to be slidable on said opposite surface portions, said opposite surface portions of said cam plate being formed to be parallel with said seating surface of said weight seat.

8. The variable capacity refrigerant compressor according to claim 4, wherein said weight means attached to said weight seat is formed as an element radially extending outward from said seating surface of said weight seat with respect to the center of said cam plate, a portion of said weight means coming into mechanical contact with said rotary support plate being arranged at a position not projecting radially outward from said seating surface of said weight seat.

9. The variable capacity refrigerant compressor according to claim 4, wherein said cam plate is received in a crank chamber defined in said compressor body in such a manner that the angle of inclination of said cam plate is adjustably changed by changing a pressure prevailing in said crank chamber to thereby cause a change in a pressure differential between said pressure in said crank chamber and a total of pressures prevailing in said plurality of cylinder bores and acting on said respective pistons.

10. The variable capacity refrigerant compressor according to claim 9, wherein said weight means attached to said weight seat is arranged to have a portion radially projecting outward from said seating surface of said weight seat, and wherein said radially projecting portion of said weight means has a plurality of through-holes formed therein as fluid passages permitting the refrigerant gas to pass therethrough within said crank chamber.

11. The variable capacity refrigerant compressor according to claim 1, wherein said cam plate is provided with a through-bore formed therein to permit said drive shaft to extend therethrough while supporting therearound said cam plate, wherein said rotary support element has a contacting surface with which said weight means comes into a mechanical contact, said contacting surface of said rotary support element, being formed as a tilted surface substantially parallel with said cam plate, being moved to said maximum inclination angle position thereof with respect to the axis of rotation of said drive shaft.

12. The variable capacity refrigerant compressor according to claim 1, wherein said weight means have a pair of spaced contacting portions coming into mechanical contact with said rotary support element in response to the movement of said cam plate toward its position of the maximum angle of inclination, said pair of spaced contacting portions of said weight means being arranged to be symmetrical with one another with respect to a top dead center of said cam plate.

13. The variable capacity refrigerant compressor according to claim 12, wherein each of said pair of spaced contacting portions of said weight means is arranged at an outer peripheral portion of said cam plate.

14. The variable capacity refrigerant compressor according to claim 12, wherein said hinge means have a pair of hinge centers symmetrically spaced from one another with respect to said top dead center of said cam plate, and wherein said pair of spaced contacting portions of said weight means have respective centers between which a distance is larger than that between said hinge centers of said hinge means.

15. The variable capacity refrigerant compressor according to claim 1, wherein said weight means comprises a heavy element and a fixing means for fixedly attaching said heavy element to said cam plate.

16. The variable capacity refrigerant compressor according to claim 15, wherein said heavy element and said fixing means are formed as an integral member.

17. The variable capacity refrigerant compressor according to claim 15, wherein said heavy element and said fixing means are formed as separate elements, said heavy element being further formed as a flat plate element.

18. A variable capacity single-headed piston type refrigerant compressor driven by an external drive source and incorporated to a vehicle climate control system comprising:

a compressor body including a cylinder block having a plurality of cylinder bores permitting a plurality of single-headed pistons to reciprocate therein;

an axial drive shaft mounted in said compressor body to be rotatable about an axis of rotation thereof and having an external end thereof to be connected to said external drive source;

a substantially circular cam plate mounted around said drive shaft, at a center portion thereof, to be rotated together with said drive shaft and to be able to change an angle of inclination thereof with respect to the axis of rotation of said drive shaft;

a rotary support element fixedly mounted on the drive shaft engaged with the cam plate by a hinge means;

an engaging means for engaging said circular cam plate with said plurality of single-headed pistons to thereby cause reciprocation of said plurality of single-headed pistons within said cylinder bores, in response to the rotation of said drive shaft and said cam plate; and a capacity control means for controlling the capacity of said compressor by adjustably changing the angle of inclination of said cam plate;

wherein said cam plate is made of an aluminum system material, and is provided with a separate weight means attached thereto, said separate weight means being made of a material having a specific gravity which is larger than that of the aluminum system material, and arranged to permit said cam plate to produce a centrifugal force counteracting an unfavorable moment acting on said cam plate when said cam plate and said drive shaft are rotated at a high speed by said external drive source and wherein the maximum of inclination of the cam plate is determined when the weight means come into contact with the rotary support plate.

19. The variable capacity single-headed piston type refrigerant compressor according to claim 18, wherein said external drive source is a vehicle engine.

* * * * *